United States Patent [19]

Kamiwano et al.

[11] Patent Number: 4,856,717

[45] Date of Patent: Aug. 15, 1989

[54] DISPERSING AND GRINDING APPARATUS

[75] Inventors: Mitsuo Kamiwano, Yokohama; Yoshitaka Inoue, Tokyo, both of Japan

[73] Assignee: Inoue Seisakusho (MFG) Co., Ltd., Japan

[21] Appl. No.: 65,259

[22] Filed: Jun. 22, 1987

[30] Foreign Application Priority Data

Jun. 20, 1986 [JP] Japan ..... 61-144193
May 11, 1987 [JP] Japan ..... 62-112623

[51] Int. Cl.[4] ..... B02C 17/16
[52] U.S. Cl. ..... 241/65; 241/172
[58] Field of Search ..... 241/171, 172, 65, 66, 241/67, 97, 80, 69

[56] References Cited

U.S. PATENT DOCUMENTS 1,649,813 11/1927 Dalgaard ..... 241/172 X
2,592,994 4/1952 Ahlmann ..... 241/172 X
3,226,044 12/1965 Matsubayashi et al. ..... 241/172
4,059,232 11/1977 Engels ..... 241/172 X

FOREIGN PATENT DOCUMENTS 906613 2/1982 U.S.S.R. ..... 241/172

*Primary Examiner*—Mark Rosenbaum
*Attorney, Agent, or Firm*—Bruce L. Adams; Van C. Wilks

[57] ABSTRACT

A grinding medium is filled in a grinding vessel of a dispersing and grinding apparatus. The medium is agitated by means of a cylindrical rotor provided within the vessel. A material entered into the vessel is ground and dispersed in liquid by means of motion of the medium. The rotor has a forward screw on the outer surface or the inner surface thereof for inducing the medium from an inflow conduit to the direction of an outflow conduit, and has a backward screw on the inner surface or the outer surface thereof for inducing the medium from the outflow conduit to the inflow conduit. The medium circulates within the vessel under guidance of these screws. The rotor rotates directly by a shaft extending within the vessel, or by an electromagnetic inductive action of rotating magnetic field provided either on the outer or inner surface of the vessel.

19 Claims, 4 Drawing Sheets

DISPERSING AND GRINDING APPARATUS

BACKGROUND OF THE INVENTION (1) Field of the Invention

The present invention relates to a dispersing and grinding apparatus in which a grinding medium is introduced within a grinding vessel, and a material is ground and dispersed in liquid by interaction with the medium, and more particularly to a dispersing and grinding apparatus which has a rotor within the vessel to induce and circulate the medium into the passage or space provided between an outer surface of the rotor and an inner wall of the vessel for grinding and dispersing the material.

(2) Background Information

It is known that a grinding medium in a dispersing and grinding apparatus is introduced into a grinding vessel and a material is ground and dispersed in liquid by interaction of a grinding medium with an agitator. As for the agitator, agitator disks and stirring rods are often used. According to this type of agitator, it is known that a material is effectively ground as it approaches the rotating agitator due to the action of high shearing stress on the grinding material; as the material is centrifuged away or separated from the agitator, shearing stress acting on the material becomes weak, and accordingly the effective grinding of the material is difficult. As a result the distribution of shearing stress acting on the material within the vessel is not uniform. Miniaturizing the vessel might make distribution of shearing stress uniform, however, as the distance to induce the material from the inflow conduit to the outflow conduit of the vessel becomes closer, the resulting shearing stress does not act effectively on the material, and therefore satisfactory results are not obtained.

A device is also known using a hollow cylinder as an agitator. But in this king of device, flow of the medium is irregular and accordingly this type is also unsatisfactory.

SUMMARY OF THE INVENTION

It is accordingly an object of the present invention to provide a dispersing and grinding apparatus to make possible efficient grinding and dispersing treatments of a material by means of a grinding medium filled in a grinding vessel, which utilizes shearing stress on the material.

Another object of the present invention is to provide a dispersing and grinding apparatus to make possible the effective grinding and dispersing treatments of the material by inducing the medium filled in the vessel along screws provided on a rotor and by extending the process of inducing the material.

Another object of the present invention is to provide a more compact dispersing and grinding apparatus and thereby reducing the quantity of the medium.

These objects are attained in accordance with the present invention by providing a grinding vessel having therein a cylindrical rotor for agitating a grinding medium and a forward screw and a backward screw provided on the rotor for directing this flow of the medium. The forward screw and backward screw are oppositely threaded to each other and are provided on an outer surface and an inner surface of the rotor respectively in such a manner that the medium circulates in a circular motion within the vessel. According to the flow of the medium and shearing stress to be generated by difference of speed between the medium, the material is ground and dispersed.

Further advantages and characteristics of the present invention will become apparent from the following description of exemplary embodiment taken in conjunction with the drawings.

DESCRIPTION OF THE PREFERRED EMBODIMENTS

Figure 1:
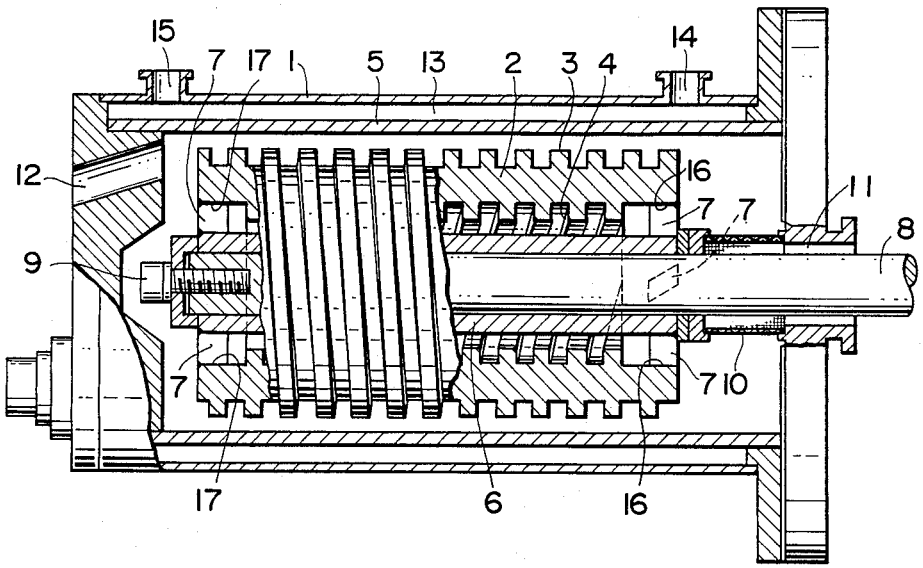
FIG. 1 is a longitudinal-sectional view along the axis of a dispersing and grinding apparatus which is one embodiment of this invention.
Figure 2:
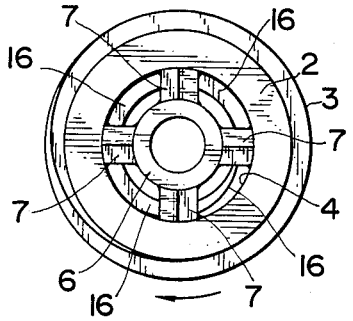
FIG. 2 is a side view of a rotor shown in FIG. 1.

The embodiment of this invention in FIG. 1 shows that a motor is used as a driving source of a rotor 2. The rotor 2 provided rotatably in a grinding vessel 1 and is designed in a cylindrical configuration. The configuration of the rotor is not limited to the above. Various other multilateral cylindrical configurations are possible such as a hexagonal configuration and the like. On the outer surface and the inner surface of the rotor, male screw and female screw are provided respectively. The male screw is used as a forward screw 3 to induce the grinding medium to move forwardly and the female screw is used as a backward screw 4 which has reverse threads against the forward screw and induces the grinding medium to move backwardly. In the drawing, the direction of screw threads are provided so that the male screw on the outer surface become the forward screw 3 and the female screw on the inner surface becomes the backwards screw 4, in consideration of rotational direction of the rotor. It is possible to provide a backward screw on the outer surface and a forward screw on the inner surface of the rotor. The screw provided on the inner surface is preferably formed to have a larger lead and increased number of threads, than the screw provided on the outer surface so that quantity of the medium to be induced is substantially equalized at the inner and outer surfaces. The space between the screw on the outer surface and an inner wall 5 of the grinding vessel as well as pitch of the screw, etc., may appropriately be predetermined depending upon the size of medium to be ground. In the drawing, the screw thread is formed as a square shaped thread; however, a trapezoidal thread, a buttress thread, a knuckle thread, a triangular thread and the like are also applicable. A portion of the screw thread is formed as one piece incorporated with the rotor. The screw thread provided on a separate cylindrical body may be mounted on the rotor. Otherwise, a propeller-like screw may be fixed to the rotor (not shown). Inside the rotor 2, a supporting drum 6 is provided co-axially with the rotor, and the supporting drum and the rotor are jointed by means of arms 7. The arms 7 are provided in such a manner that the side surfaces of the arms 7 incline on the bias relative to the position of edge surfaces of the front and rear thereof so that when the rotor is rotating, inflow and outflow of grinding medium are promoted (dotted line in FIGS. 1 and 2). The supporting drum 6 is inserted on a shaft 8 which is driven by a motor (not shown), and is fixed to the shaft by means of a mounting screw 9 and the like. On the outer surrounding of the forward side of the shaft 8, an outflow conduit 11 is provided for discharging the finished ground product passing through a separator or a screen 10 for separating the finished ground product from the grinding medium. The outflow conduit may be provided at other suitable positions. In the grinding vessel 1, an inflow conduit 12 for material to be ground and an outflow conduit for medium (not shown) are provided. Also, on the outer surface of the grinding vessel 1, an inflow conduit 14 and an outflow conduit 15 are provided for circulating a temperature control medium such as water, air and the like into a jacket 13 in order to cool or warm the material.

When the rotor 2 rotates by way of shaft 8, the grinding medium filled in the vessel (now shown) is induced to the right in this drawing through narrow grooves of the forward screw 3. By means of agitation movement of the medium, the material is ground and dispersed. This grinding and dispersing treatment is successively continued with the movement of the medium to the right end of the forward screw. The grinding medium and the material conveyed to the right end of this drawing by means of the forward screw 3 enter the inside of the rotor 2 through an opening 16 defined between arms 7, and the medium is induced to the left in this drawing by means of the backward screw 4. The medium which has flowed past the left end of the backward screw 4 flows out to the left of the rotor 2 through an opening 17 defined between arms 7 to the left of this drawing. The medium and the material are again flowed to the right by means of the forward screw 3 and thus continuous circulation results. The finished material which is ground and dispersed into liquid, flows out from the screen 10 through the material conduit 11, and is carried to the next process.

The grinding vessel and the rotor, etc., of this invention are provided as a horizontal type but are not limited to such. A vertical type may be also applied to this invention.

FIG. 3 through 8 show the embodiments in which a rotor rotates directly by action of a rotating magnetic field.

Figure 3:
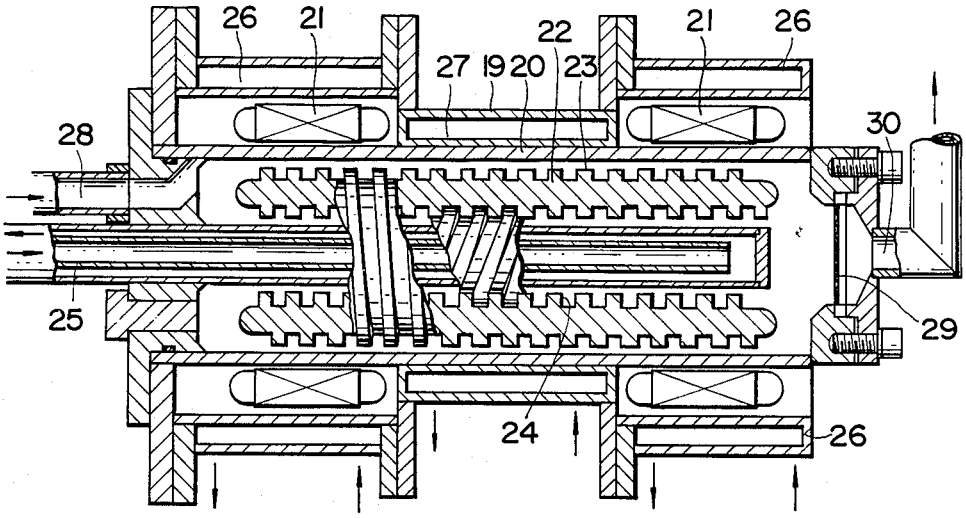
FIG. 3 is a longitudinal-sectional view along the axis of a dispersing and grinding apparatus which is another embodiment of this invention.

In FIG. 3, electromagnetic coils 21 which generate the rotating magnetic field are provided at the outside of an inner wall 20 of a grinding vessel 19. The number of the electromagnetic coils utilized will vary upon the size of a rotor 22. The entirety of the rotor 22, or a portion thereof that includes at least that section which faces the electromagnetic coils 21, is made of proper conductor material, such as iron, silicon steel, amorphous alloy and the like, so that the rotor 22 may rotate by the electromagnetic inductive action of the electromagnetic coils. On the outer surface and inner surface of the rotor 22, a forward screw 23 and a backward screw 24 are provided respectively. Within the rotor 22, temperature control conduits 25 are provided in order to circulate thereinto the temperature control medium such as a refrigerant. Further, on the outer side of the grinding vessel 19 a jacket 26 is provided for cooling the electromagnetic coil with water, air or the like; and a jacket 7 is also provided for regulating the temperature within the vessel. At one end of the grinding vessel, a material inflow conduit 28 is provided, and at the other end, a material outflow conduit 30 is provided through a separator 29. The grinding vessel is designed to be wholly sealed.

The rotor 22 is placed in the vessel in a free condition and when subject to the influence of excitation of the electromagnetic coils 21, the rotor receives electromagnetic inductive action by rotating magnetic field of the electromagnetic coils and begins to rotate. By rotation of the rotor 22 the material and the grinding medium (not shown) are induced and circulated along the grooves of the screws from the outer surface to the inner surface of the rotor by means of the forward screw 23 and the backward screw 24. The ground material, when completed, is removed through the material outlet conduit 30.

In this embodiment, the electromagnetic coils are provided closely to the outer side of the rotor, but it is possible to provide same within the rotor.

Figure 4:
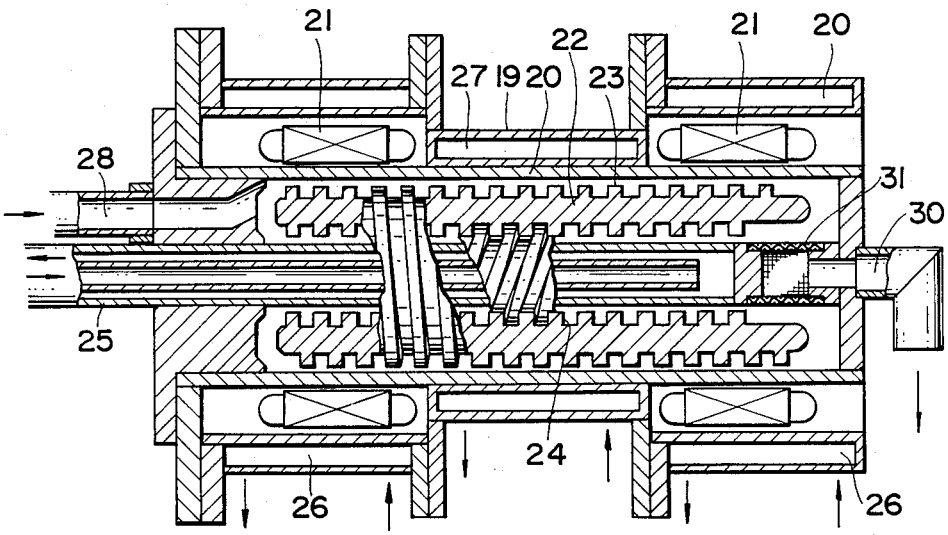
FIG. 4 is a longitudinal-sectional view along the axis of a dispersing and grinding apparatus which is a further embodiment of this invention.

An embodiment shown in FIG. 4 is in principle similar in construction to that illustrated in FIG. 3 and described above, so identical parts are given identical reference numbers. The differences from FIG. 3 are that the outflow conduit 30 for the material and the temperature control conduit 25 are connected with a cylindrical separator 31.

Figure 5:
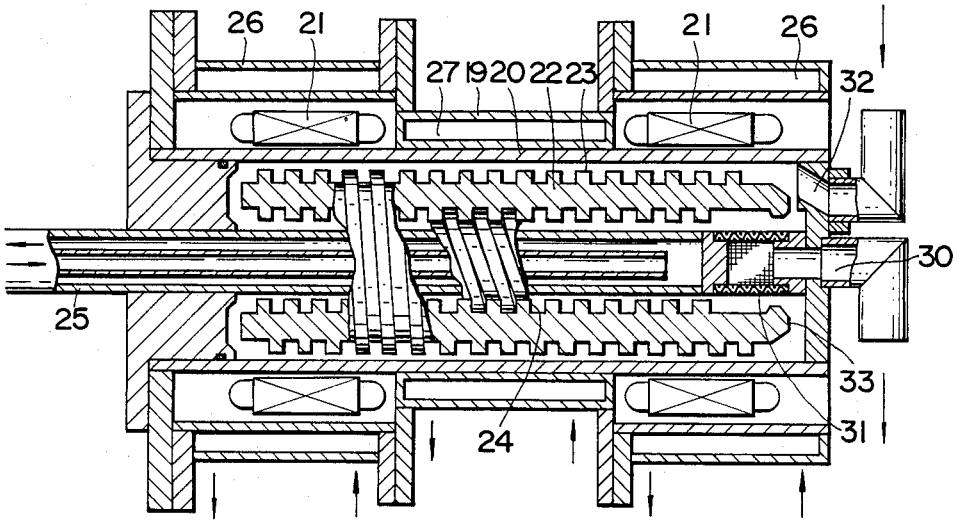
FIG. 5 is a longitudinal-sectional view along the axis of a dispersing and grinding apparatus which is a further embodiment of this invention.

The embodiment shown in FIG. 5 is also similar in construction to that shown in FIG. 4, so identical parts are given identical reference numbers. The difference from FIG. 4 is that an inflow conduit 32 for the material is provided on the same side with the outflow conduit 30 for the material. Accordingly in the embodiment shown in FIG. 5, the direction of threads of a forward screw is designed in such a manner that the material is conveyed to the left in this drawing by means of the forward screw provided on the outer surface of the rotor 22, and the direction of threads of the backward screw 24 is also designed in such a manner that the material passing to the left is returned to the right by means of the backward screw 24 provided on the inner surface of the rotor 22. Furthermore, a right edge 33 of the rotor 22 is extended inwardly so that the material poured from the inflow conduit 32 does not flow directly into the outflow conduit 30 for the material.

In the embodiment shown in FIG. 3 through FIG. 5 the rotors sometime comes in contact with the inner wall of the vessel in the stationary state. However, when the rotor begins to rotate by electromagnetic inductive action, the grinding medium slides into the space between the screw of the outer surface and the inner wall, and the rotor rotates smoothly. If there is a tendency that the rotor leans towards one-side due to the difference of thrust of the screws provided respectively on the outer and inner surface of the rotor, this can be adjusted by increasing the number of threads of the screw provided on the inner surface than that of the screw provided on the outer surface and enlarging the surface area of the inner surface.

Figure 6:
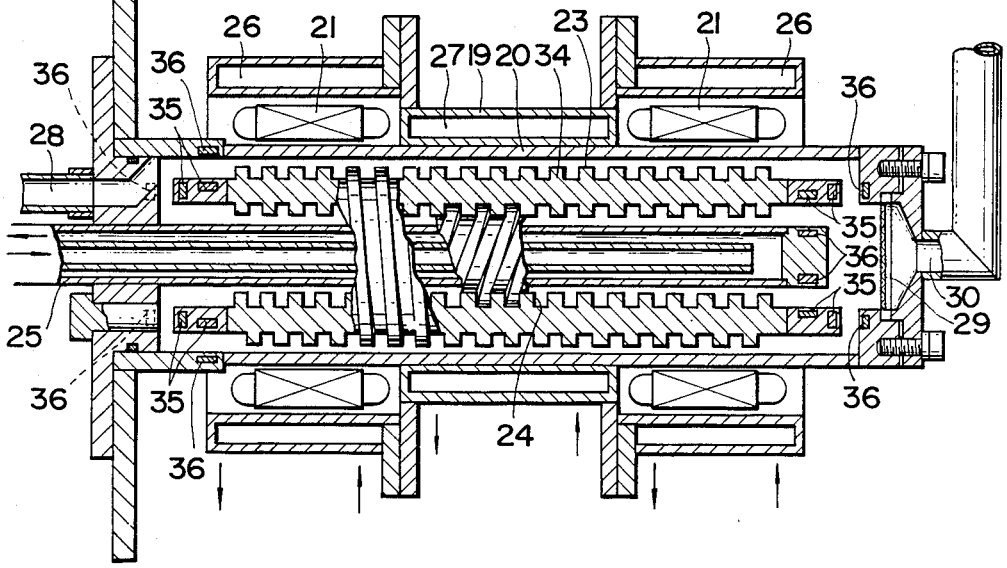
FIG. 6 is a longitudinal-sectional view along the axis of a dispersing and grinding apparatus which is a further embodiment of this invention.

An embodiment shown in FIG. 6 is in principle similar in construction to that shown in FIG. 3 except for the construction of the motor. Hence, identical parts are given identical reference numbers. In this embodiment, the rotor is supported by the magnetic bearing. In other words, permanent magnets 35 are provided at both ends of a rotor 34 and facing these permanent magnets are other permanent magnets 36 which are provided, for suspension of the rotor, at the end plates, etc., of the temperature control conduits 25 and the grinding vessel 19. By doing so, the rotor 34 is supported in the vessel at a predetermined position, and accordingly rotates more smoothly by action of the rotating magnetic field of the electromagnetic coils. As a result, the material and the medium circulate from the outer surface to the inner surface of the rotor 34 by means of the forward screw 23 and the backward screw 24, and perform grinding and dispersing of the material.

Figure 7:
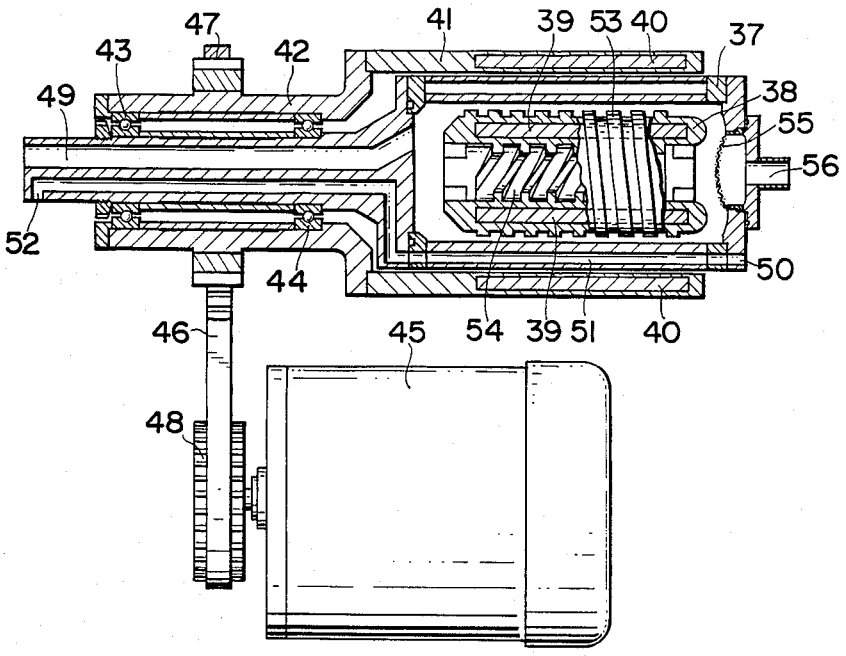
FIG. 7 is another longitudinal-sectional view along the axis of a dispersing and grinding apparatus which is a further embodiment of this invention.
Figure 8:
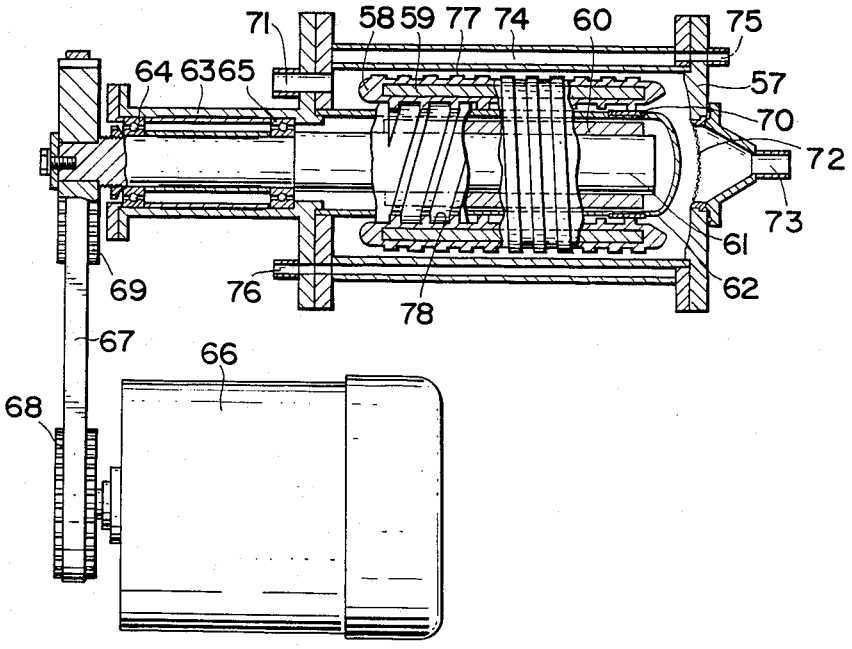
FIG. 8 is a further longitudinal-sectional view along the axis of a dispersing and grinding apparatus which is a further embodiment of this invention.

In the embodiments in FIG. 3 through 6, the rotating magnetic field is generated by electromagnetic coils, but it is possible for the field to be generated by a permanent magnet as shown in FIGS. 7 and 8.

In FIG. 7 a permanent magnet 39 is provided within a rotor 38 placed within a grinding vessel 37, and the other permanent magnet 40 which makes a magnetic coupling to the permanent magnet 39 is provided in a driving case 41 surrounding the vessel 37. Driving case 41 is rotatably supported by bearings 43 and 44 on a body portion 42, and rotates by means of a motor through a belt 46 and pulleys 47 and 48. On the body portion 42, a material inflow conduit 49 is provided, and further a discharge outflow conduit 52 is provided on the same end portion so as to discharge the temperature control medium introduced from an inflow conduit 50 located at the opposite end of the vessel 37 into a jacket 51.

Thus, this forces the driving case 41 to rotate, the rotor 38 rotates by action of permanent magnets 39 and 40. When the rotor 38 rotates, the material and the medium (not shown) are circulated according to guidance of a forward screw 53 and a backward screw 54 along the grooves of a screw from the outer surface of the rotor to the inner surface. The finished material which is ground and dispersed is ejected from a material outflow conduit 56 through a screen 55. According to the embodiment, the axial situation of the rotor 38 is controlled by magnetic coupling of permanent magnets 39 and 40.

An embodiment shown in FIG. 8 is provided with a rotating permanent magnet at the inner portion of the rotor. That is, a set of permanent magnets 59 is provided at a rotor 58 disposed in the inner portion of a vessel 57, and the other set of permanent magnets 60 electromagnetically connecting to the permanent magnet 59 is fixed to a shaft 61 disposed at the center of the vessel 57. Between the rotor 38 and the permanent magnet 60, an interval wall 62 is disposed, which isolates the permanent magnet 60 and a shaft 61 from the vessel 57. The wall 62 is made of non-magnetic materials. The shaft 61 is rotatably supported by bearings 64 and 65 to a main body 63 provided at one end of the vessel 57, and the shaft 61 rotates by means of a belt 67 and pulley 68 and 69. If desired, bearing 70 made of Teflon (Trade Mark) or ceramics may be provided at the outer periphery of the wall 62 to support the rotor 58, and this bearing 70 may be omitted, if unnecessary. A material inflow conduit 71 for the material to be treated is provided at one end of the vessel 57, while at the other end thereof a screen 72 and an outflow conduit 73 are provided, respectively. Further, a jacket 74, an inflow conduit 75 for the temperature control medium and an outflow conduit 76 are provided at the outer periphery of the vessel 57.

Thus, the rotor 58 rotates through the permanent magnet 59 and 60 according to the rotation of the shaft 61. By the rotation of the rotor 58, materials and medium are circulated according to guidance of a forward screw 77 and a backward screw 78 along the grooves of the screw from the outer surface to the inner surface of the rotor. The finished material which is ground and dispersed is finally ejected from the outflow condits 73 through the screen 72. In comparison with the embodiment shown in FIG. 7, the diameter of the rotor in FIG. 8 is made larger, which results in elongation of the process for grinding and dispersing the material to be treated.

According to the present dispersing and grinding apparatus, the medium is conveyed along the relatively narrow groove of screws and accordingly the distribution of shearing stress becomes substantially uniform. Further, the medium circulates along screws provided on the outer and inner surfaces of the rotor and accordingly it is possible to elongate the process for grinding and dispersing the material. Compared with the conventional apparatus, the apparatus of the present invention can be miniaturized and the quantity of the medium can be decreased, resulting as expected in greater efficiency.

What is claimed is:

1. A dispersing and grinding apparatus for grinding a material and dispersing it into liquid by interaction with a grinding medium, comprising:

a grinding vessel having an elongate inner wall;

a cylindrical rotor rotatably disposed within said grinding vessel for agitating a mixture of grinding medium and material within said grinding vessel; and a forward screw provided on an outer surface of said rotor to positively induce the mixture to flow forwardly and a backward screw provided on an inner surface of said rotor to positively induce the mixture to flow backwardly, the forward screw being spaced from the vessel inner wall to define therebetween a narrow space through which the mixture forwardly flows, and the forward and backward screws being configured to impart a generally uniform motion to the grinding medium in response to rotation of said rotor to effect circulation of the mixture within the grinding vessel accompanied by thorough dispersion of the material.

2. A dispersing and grinding apparatus according to claim 1, wherein said rotor has a supporting drum provided therein and wherein said supporting drum is fixed with a driving shaft.

3. A dispersing and grinding apparatus according to claim 2, wherein an arm is provided between said supporting drum and said rotor for accelerating inflow and outflow of said medium.

4. A dispersing and grinding apparatus according to claim 1, wherein said screw provided on said inner surface of said rotor is formed to have larger lead than said screw provided on said outer surface.

5. A dispersing and grinding apparatus according to claim 1, wherein said rotor rotates by action of a rotating magnetic field.

6. A dispersing and grinding apparatus according to claim 5, wherein said rotating magnetic field is generated by action of electromagnetic coils.

7. A dispersing and grinding apparatus according to claim 5, wherein said rotating magnetic field is generated by rotation of permanent magnets.

8. A dispersing and grinding apparatus according to claim 5, wherein temperature within said grinding vessel is controlled by a temperature control medium circulating within said rotor.

9. A dispersing and grinding apparatus for grinding and dispersing a material by the use of a grinding medium, comprising:

a grinding vessel having an elongate inner wall;

a cylindrical rotor rotatably disposed within said grinding vessel for agitating a mixture of grinding medium and material within the grinding vessel;

a forward screw provided on an outer surface of said rotor to positively induce the mixture to flow forwardly and a backward screw provided on an inner surface of said rotor to positively induce the mixture to flow backwardly, the forward screw being spaced from the vessel inner wall to define therebetween a narrow space through which the mixture forwardly flows, and the forward and backward screws being configured to impart a generally uniform motion to the grinding medium in response to rotation of said rotor to effect circulation of the mixture within the grinding vessel accompanied by thorough dispersion of the material;

an internal wall made of non-magnetic substance inside said rotor;

a shaft at the inside of said internal wall; and a set of permanent magnets at the shaft and the rotor to connect said shaft and said rotor electromagnetically.

10. A dispersing and grinding apparatus, comprising:

a vessel having an internal surface, an inlet for admitting a material to be ground and a grinding medium, and an outlet for discharging ground material;

a cylindrical rotor rotatably mounted in the vessel about a longitudinal axis thereof, wherein the rotor has means defining an outer surface spaced from and facing said internal surface of the vessel to define therebetween a narrow space and having a first screw thereon for positively moving the material and grinding medium through the narrow space in one axial direction in response to the rotation of the rotor, and means defining a radially inner surface of the rotor coaxial with the outer surface and having a second screw thereon for positively moving the material and grinding medium in an axial direction opposite said one axial direction in response to the rotation of the rotor, the first and second screws being effective to impart a generally uniform motion to the grinding medium in response to rotation of the rotor to effect circulation of the material and grinding medium within the vessel together with thorough dispersion of the material; and means for rotating the rotor.

11. The apparatus according to claim 10, wherein the screws on the inner and outer surfaces comprise helical grooves.

12. The apparatus according to claim 10, wherein the means for rotating the shaft comprises a driven shaft extending through the cylindrical rotor and coupled thereto.

13. The apparatus according to claim 12, wherein the rotor includes a supporting drum connected to the shaft and having an outer surface facing the inner surface of the rotor, and means rotatably coupling the rotor with the supporting drum.

14. The apparatus according to claim 13, wherein the rotatably coupling means comprises arms between the inner surface of the rotor and the outer surface of the supporting drum and wherein the arms are configured to accelerate flow of the medium in said opposite direction.

15. The apparatus according to claim 10, wherein the means for rotating the rotor comprises electromagnetic driving means for producing a rotating magnetic field for electromagnetically rotationally driving the rotor.

16. The apparatus according to claim 15, wherein the means for producing the rotating magnetic field comprises electromagnetic coils disposed around the vessel.

17. The apparatus according to claim 15, wherein the means for producing the rotating magnetic field comprises means for rotating permanent magnets relative to the vessel and coaxial with the rotor.

18. The apparatus according to claim 17, wherein the rotor is hollow and has permanent magnets therein, and wherein the rotating permanent magnets are disposed within a hollow portion of the rotor.

19. The apparatus according to claim 17, wherein the rotor has permanent magnets therein, and the rotating permanent magnets are disposed around the vessel.

* * * * *